US006698157B1

(12) United States Patent
Porter

(10) Patent No.: US 6,698,157 B1
(45) **Date of Patent: *Mar. 2, 2004**

(54) STRUCTURAL INSULATED PANEL BUILDING SYSTEM

(76) Inventor: William H. Porter, P.O. Box 249, Saugatuck, MI (US) 49453

( * ) Notice: Subject to any disclaimer, the term of this patent is extended or adjusted under 35 U.S.C. 154(b) by 127 days.

This patent is subject to a terminal disclaimer.

(21) Appl. No.: 09/703,039

(22) Filed: Oct. 31, 2000

(51) Int. Cl.[7] ..... E04C 2/34

(52) U.S. Cl. ..... 52/794.1; 52/582.1; 52/309.2; 52/309.7; 52/309.9; 52/592.1; 52/787.1; 52/790.1

(58) Field of Search ..... 52/582.1, 309.7, 52/309.2, 309.9, 592.1, 783.1, 787.1, 790.1, 794.1, 800.1, 801.1, 630, 309.4, 309.5, 506.01; 428/317.7

(56) References Cited

U.S. PATENT DOCUMENTS

| | | | | |
|---|---|---|---|---|
| 919,057 | A | 3/1909 | Moore | |
| 1,250,594 | A | 12/1917 | Knapp | |
| 1,474,657 | A | 11/1923 | Walper | |
| 2,111,922 | A | 3/1938 | Borkenstein | 20/74 |
| 2,875,478 | A | 3/1959 | Andre | 20/4 |
| 3,496,058 | A | 2/1970 | Schroter et al. | 161/119 |
| 3,557,840 | A | 1/1971 | Maybee | 138/149 |
| 3,654,053 | A | 4/1972 | Toedter | 161/43 |
| 3,692,620 | A | 9/1972 | Schmidt et al. | 161/88 |
| 3,731,449 | A | 5/1973 | Kephart, Jr. | 52/631 |
| 3,753,843 | A | 8/1973 | Hutchison | 161/43 |
| 3,911,554 | A | 10/1975 | Ford | 29/527 |
| 4,004,387 | A | 1/1977 | Ellingson | 52/309.3 |
| 4,024,684 | A | 5/1977 | Homgren | 52/127 |
| 4,032,689 | A | 6/1977 | Johnson et al. | 428/55 |
| 4,037,377 | A | 7/1977 | Howell et al. | 52/309.9 |
| 4,051,641 | A | 10/1977 | Elliott | 52/262 |
| 4,068,437 | A | 1/1978 | Byxbe et al. | 52/464 |
| 4,147,004 | A | 4/1979 | Day et al. | 52/309.9 |

(List continued on next page.)

FOREIGN PATENT DOCUMENTS

| | | | | |
|---|---|---|---|---|
| FR | 2 726 019 | * 10/1994 | | 52/794.1 |
| GB | 2 108 546 | * 5/1983 | | 52/794.1 |

*Primary Examiner*—Lanna Mai
*Assistant Examiner*—Dennis L. Dorsey
(74) *Attorney, Agent, or Firm*—Emrich & Dithmar

(57) ABSTRACT

A building system includes structural insulated panels having an inner insulating core such as of foam plastic or agri-board and strong thin facings such as of plastic impregnated/reinforced paper on opposed surfaces of the insulating core. The impregnated/reinforced paper provides the panel with high strength and facilitates attaching the panel to dimensional lumber or to similar adjacent panels. The opposed outer facings overlap/extend beyond the insulating core's edges in various configurations so as to provide several different panels, each adapted to satisfy a specific structural purpose. In a first configuration, three edges of the outer facings overlap respective edges of the insulating core for also overlapping a base plate, a top plate and an adjacent stud, panel, window or doorjamb. The fourth edge of the panel is adapted to be overlapped by the opposed outer facings of an adjacent panel and may include a structural insert within the insulating core to receive fasteners for securing the adjacent panel. In a second configuration, all four edges of the opposed outer facings overlap the four edges of the insulating core for also overlapping dimensional lumber on all four edges or for overlapping an adjacent panel(s) on one or two vertical edges. A third panel configuration has all four edges of the opposed outer facings overlapping adjacent edges of the panel's insulating core and further includes connector attachment material disposed beneath the outer facings and is easily sized in the field for a specific installation.

14 Claims, 6 Drawing Sheets

U.S. PATENT DOCUMENTS

| | | | | |
|---|---|---|---|---|
| 4,169,688 | A | 10/1979 | Toshio | 404/40 |
| 4,170,859 | A | 10/1979 | Counihan | 52/763 |
| 4,283,898 | A | 8/1981 | Claver | 52/584 |
| 4,402,170 | A | 9/1983 | Seidner | 52/631 |
| 4,430,833 | A | 2/1984 | Balzer et al. | 52/255 |
| 4,443,988 | A | 4/1984 | Coutu, Sr. | 52/309.9 |
| 4,471,591 | A | 9/1984 | Jamison | 52/309.9 |
| 4,671,038 | A | 6/1987 | Porter | 52/586 |
| 4,704,837 | A | 11/1987 | Menchetti et al. | 52/631 |
| 4,726,973 | A | 2/1988 | Thompson | 425/45 |
| 4,765,105 | A | 8/1988 | Tissington et al. | 52/309.11 |
| 4,786,547 | A | 11/1988 | St-Michel | 428/215 |
| 4,856,244 | A | 8/1989 | Clapp | 52/309.7 |
| 4,865,912 | A | 9/1989 | Mitsumata | 428/285 |
| 4,961,298 | A | 10/1990 | Nogradi | 52/235 |
| 4,964,933 | A | 10/1990 | Hata et al. | 156/209 |
| 5,058,333 | A | 10/1991 | Schwartz | 52/73 |
| 5,062,250 | A | 11/1991 | Buzzella | 52/584 |
| 5,081,810 | A | 1/1992 | Emmert | 52/221 |
| 5,140,086 | A | 8/1992 | Hunter et al. | 527/103 |
| 5,224,315 | A | 7/1993 | Winter, IV | 52/309.8 |
| 5,269,109 | A | 12/1993 | Gulur | 52/309.9 |
| 5,345,738 | A | 9/1994 | Dimakis | 52/309.9 |
| 5,428,929 | A | 7/1995 | Reese | 52/288.1 |
| 5,497,589 | A | 3/1996 | Porter | 52/309.7 |
| 5,509,242 | A | 4/1996 | Rechsteiner et al. | 52/270 |
| 5,519,971 | A | 5/1996 | Ramirez | 52/220.2 |
| 5,573,829 | A | 11/1996 | Decker | 428/156 |
| 5,628,158 | A | 5/1997 | Porter | 52/309.9 |
| 5,638,651 | A | 6/1997 | Ford | 52/309.7 |
| 5,641,553 | A | 6/1997 | Tingley | 428/114 |
| 5,755,068 | A | 5/1998 | Ormiston | 52/314 |
| 5,842,314 | A | 12/1998 | Porter | 52/309.7 |
| 5,932,171 | A | 8/1999 | Malchesky | 52/58 |
| 5,950,389 | A | 9/1999 | Porter | 52/586.1 |
| 5,953,883 | A | 9/1999 | Ojala | 52/794.1 |
| 6,205,729 | B1 * | 3/2001 | Porter | 52/309.7 |
| 6,209,284 | B1 * | 4/2001 | Porter | 52/794.1 |
| 6,240,704 | B1 * | 6/2001 | Porter | 52/794.1 |
| 6,269,608 | B1 * | 8/2001 | Porter | 52/794.1 |
| 6,308,491 | B1 * | 10/2001 | Porter | 52/794.1 |
| 6,408,594 | B1 * | 6/2002 | Porter | 52/794.1 |
| 6,481,172 | B1 * | 11/2002 | Porter | 52/506.01 |

* cited by examiner

STRUCTURAL INSULATED PANEL BUILDING SYSTEM

FIELD OF THE INVENTION

This invention relates generally to structural panels used in building construction and is particularly directed to a building system employing structural insulated panels for use in walls, roofs, ceilings and floors.

BACKGROUND OF THE INVENTION

Most houses are stick built, i.e., constructed of 2× dimensional structural lumber members and nails. Wallboard is typically attached to the 2× dimensional structural lumber members in forming the walls and ceilings of the stick built house. Structural Insulated Panel's (SIPs) are increasingly being used in building construction as an alternative to the stick built approach. SIP construction employs rigid outer facings attached to one or both sides of a light insulating foam core. High strength bonding of the outer facings to the inner core forms a structural I-beam in the form of flat panels. Previously mentioned wallboard panels as well as SIPs are attached to the 2× dimensional structural lumber members by conventional connectors such as nails or screws. SIPs are attached to base and top plates forming part of the 2× dimensional lumber framework as well as to spaced studs extending between the base and top plates and typically spaced at 16 inch intervals. The SIP panel must be pre-cut to size for a specific installation and modification on the job for a particular installation is generally not feasible. A setting compound is typically used to seal the joint between adjacent SIPs for aesthetic and environmental reasons. Current SIPs cannot be securely joined together along their abutting edges, thus requiring spaced 2× dimensional lumber studs for supporting the panels in forming a wall, roof, ceiling or floor. Extending the outer facing of current SIPs so as to overlap an adjacent SIP and span the joint between adjacent SIPs is impractical because of the thickness of the panel's facing substantially increases the thickness of the panel joint when arranged in an overlapping manner. The requirement for 2× dimensional lumber studs and a setting compound to seal the joint between adjacent panels as well as the inability to modify SIPS in the field for specific installations increases the cost and complexity of this construction approach.

The present invention addresses the aforementioned limitations of the prior art by eliminating the need for 2× dimensional structural lumber studs as well as a sealing compound applied to the joint of abutting SIPs by permitting adjacent SIPs to be securely connected along their abutting edges in a sealed manner. Rigid structural members within the panel's insulating core provide compression strength for the panel and serve as nailers for securely attaching a panel to either an adjacent SIP or to a base or top plate. The inventive SIPS are easily modified in the field for adapting to a particular installation without diminishing their ease of installation in a secure manner to provide a high strength structure.

OBJECTS AND SUMMARY OF THE INVENTION

Accordingly, it is an object of the present invention to provide a building system employing a modular structural insulated panel which reduces the need for custom factory cutting of the panels and the time required for field erection.

It is another object of the present invention to provide a lightweight, high strength structural insulated panel capable of forming high strength connections to dimensional lumber members, such as used in plates, jambs, header edging and jack studs, or to other similar panels using conventional connectors such as nails, staples, screws or adhesives.

Yet another object of the present invention is to provide a modular structural insulated panel which is easily modified in the field for sizing and connection to adjacent structural members for use in various applications.

This invention contemplates a structural arrangement for a building having plural connected support members, the structural arrangement comprising: a first planar insulating core having plural peripheral edges and first and second opposed outer surfaces; first and second reinforced paper sheets respectively disposed on the core's first and second opposed surfaces and having respective plural peripheral edges each extending beyond an adjacent edge of the core and forming a slot disposed about at least a portion of the periphery of the core; a building support member disposed in a first portion of the slot and engaging a peripheral edge of the core; and a first connector inserted through an edge of the first reinforced paper sheet extending beyond an adjacent edge of the core, wherein the first connector is further inserted into the building support member for securely attaching the core to said building support member.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
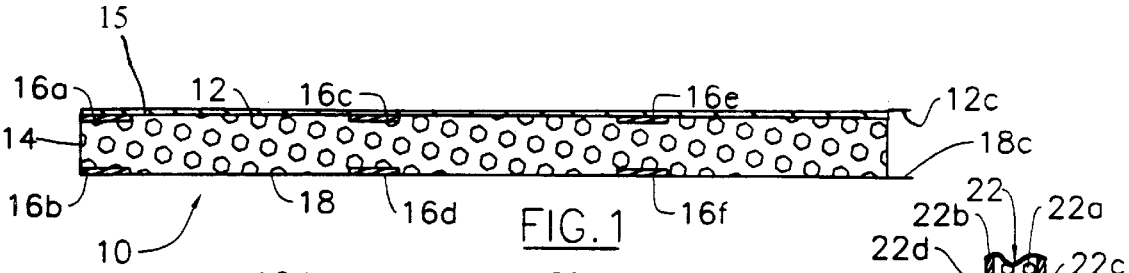
FIGS. 1, 2 and 3 are respectively top, side elevation and end-on views of a structural insulated panel in accordance with one embodiment of the present invention.
Figure 2:
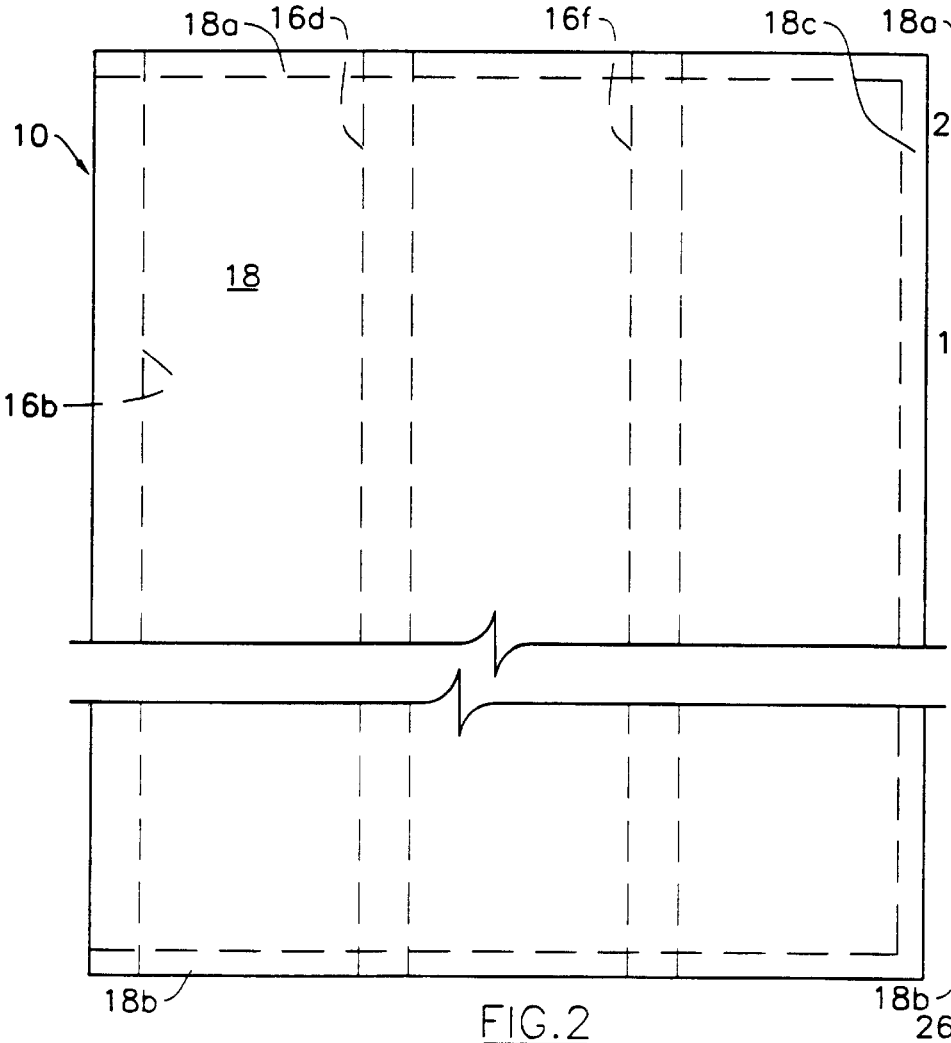
Figure 3:
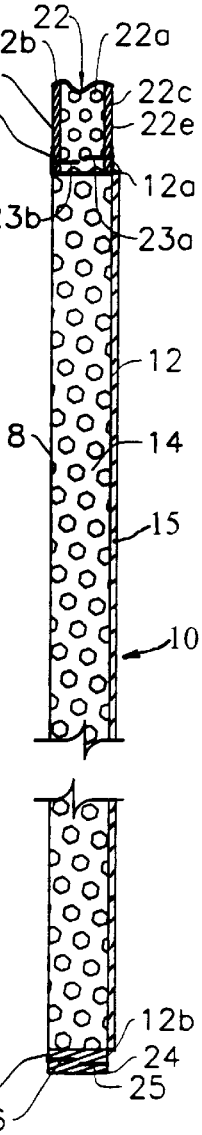

Referring to FIGS. 1, 2 and 3, there are respectively shown top, side elevation and end-on views of a structural insulated panel 10 in accordance with one embodiment of the present invention. Structural insulated panel 10 includes an inner insulating core 14 having opposed first and second sides. Disposed on the insulating core's first side is a first outer facing 12, while disposed on the core's second opposed surface is a second outer facing 18. The insulating core 14 and first and second outer facings 12, 18 are generally rectangular in shape, with the edges on three of the four edge portions of the first and second outer facings extending beyond adjacent respective edges of the inner insulating core in an overlapping manner. By "overlapping" herein is meant that an edge of a panel's outer facing extends beyond an adjacent edge of the panel's inner insulating core so as to overlap an edge of an opposed outer facing disposed on the other side of the panel's insulating core. Thus, adjacent edges 12*a* and 18*a*, 12*b* and 18*b*, and 12*c* and 18*c* respectively of the first and second outer facings 12, 18 are disposed in facing relationship to one another in an overlapping manner about three edges of the outer periphery of the inner insulating core 14. The first and second outer facings 12, 18 do not extend beyond the fourth edge of the inner insulating core 14. A backing material sheet 15 may be disposed between and adhered to the panel's first outer facing 12 and its insulating core 14. The backing material sheet 15 increases the strength of the panel and may be comprised of a conventional building material such as wood, heavy paper composite, plastic, metal, or gypsum composite. The extension of the various edges of the first and second outer facings 12, 18 beyond adjacent edge portions of the inner insulating core 14 allows for the secure connection between adjacent structural insulated panels, as well as secure connection of the structural insulated panel to a building structural member inserted in the slot formed between overlapping edges of the first and second outer facings as described in detail below. This latter arrangement is shown in the end-on view of FIG. 3 of the structural insulated panel 10 shown in FIG. 1. In FIG. 3, a second structural insulated panel 22 is shown inserted between and connected to adjacent edges 12*a* and 18*a* of the first and second outer facings 12, 18, respectively. The edge of the second structural insulated panel 22 is disposed in abutting contact with the upper edge of structural insulated panel 10 and is maintained in secure engagement with structural insulated panel 10 by means of connectors 23*a* and 23*b* respectively inserted through facing edges 12*a* and 18*a* and into the inner insulating core 22*a* of the second structural insulated panel 22 for securely connecting the insulating cores of the two panels. Connectors 23*a* and 23*b* are also inserted through outer facings 22*e* and 22*d* and into internal struts 22*c* and 22*b*, respectively, of the second structural insulated panel 22. Similarly, a structural member 24 is shown inserted in the slot formed by adjacent edges 12*b* and 18*b* of the first and second outer facings 12, 18 and disposed in abutting engagement with the lower edge of the structural insulated panel 10. Connectors 25 and 26 are inserted through outer facing edges 12*b* and 18*b*, respectively, and into the structural member 24 for securely attaching the structural insulated panel's insulating core 14 to the structural member.

Disposed within the insulating core 14 and in contact with a respective outer facing are plural struts 16*a*–16*f*. Thus, struts 16*a*, 16*c* and 16*e* are disposed in the insulating core 14 in contact with the first outer facing 12. Similarly, struts 16*b*, 16*d* and 16*f* are disposed in the insulating core 14 and in contact with the second outer facing 18. The insulating core 14 is preferably comprised of agri-board or foam plastic such as expanded polystyrene or urethane. Each of the first and second outer facings 12, 18 is preferably comprised of reinforced paper such as plastic impregnated paper, or metal, plastic or fiberglass reinforced paper. Outer facings of plastic impregnated paper sheets in accordance with one embodiment of the present invention are comprised of paper or box board impregnated with urethane or polyisocyanurate plastic. Conventional means such as an adhesive in the form of mastic or epoxy cement may be used to join the first and second outer facings 12, 18 to opposed surfaces of the inner insulating core 14. The struts are preferably comprised of wood, heavy paper composite, plastic or metal. The struts increase the bending strength as well as the compression strength of the structural insulated panel 10. The struts also serve as nailers for connecting the structural insulated panel 10 to either another similar panel, or to a building structural member such as a 2× dimensional lumber member used in conventional building construction. The overlapping edges of facing portions of the first and second outer facings 12, 18 disposed beyond an adjacent edge of the inner insulating core 14 allow either another similar panel or a building structural member to be inserted in the slot formed by the pair of facing overlapping edges of the two panel facings for either securely connecting adjacent panels together or connecting a panel to a building structural member as described below.

Figure 4:
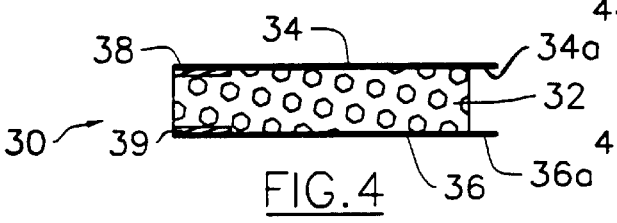
FIGS. 4 and 4*a* are respectively top and partial side elevation views of another embodiment of a structural insulated panel in accordance with the present invention, where the side elevation view is shown in phantom.
Figure 4A:
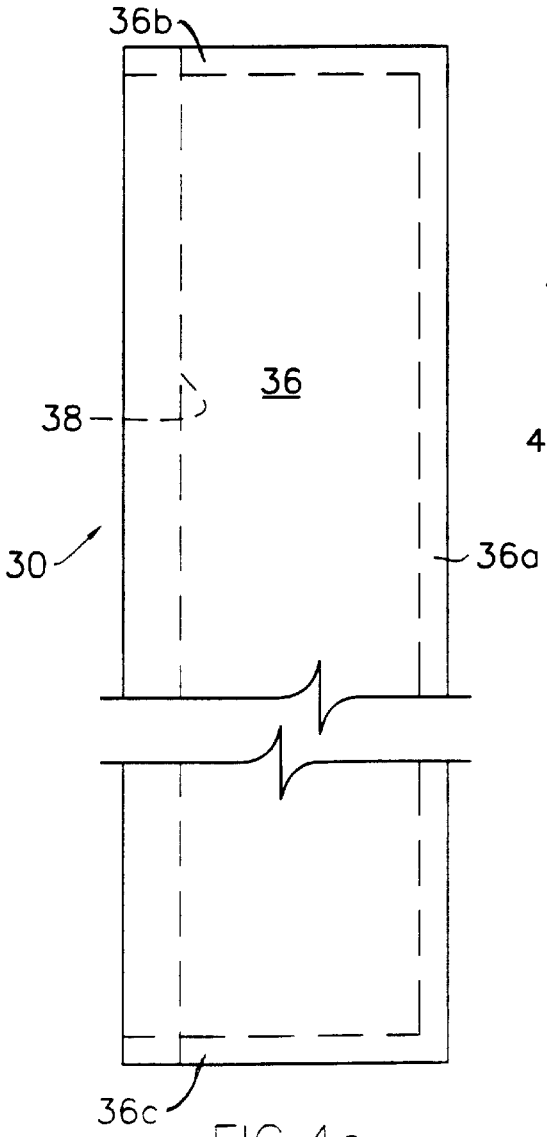

Referring to FIGS. 4 and 4*a*, there are respectively shown top and partial side elevation views of another embodiment of a structural insulated panel 30 in accordance with the present invention. Structural insulated panel 30 includes an inner insulating core 32 with first and second outer surfaces. First and second outer facings 34, 36 are respectively affixed to the first and second opposed outer surfaces of the panel's insulating core 32. As shown in FIG. 4*a*, the second outer facing 36 includes peripheral edges 36*a*, 36*b* and 36*c* extending beyond adjacent edge portions of the panel's insulating core 32. The panel's first outer facing 34 similarly has three peripheral edges extending beyond respective adjacent edges of the panel's insulating core 32 in an overlapping arrangement. The fourth edges of each of the first and second outer facings 34, 36 do not extend beyond the adjacent edge of the panel's insulating core 32. Disposed within the insulating core 32 and in contact with the first and second outer facings 34, 36 are first and second struts 38 and 39, respectively. Adjacent facing edges 34*a* and 36*a* of the first and second outer facings 34, 36 extend beyond the adjacent edge of the panel's insulating core 32 and form a slot along the side edge of the panel. This slot is adapted to receive an edge of a similarly configured second structural insulated panel, where the outer facings of the second panel do not overlap, or extend beyond, the edge of the panel's insulating core. Connectors are inserted through the overlapping edges 34*a* and 36*a* into the second panel or into a building structural member for securely attaching the structural insulated panel 30 to either another panel or to a building structural member.

Figure 5:
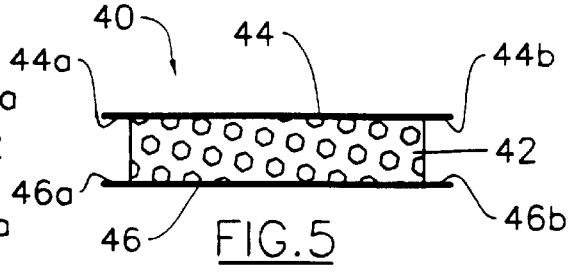
FIGS. 5 and 5*a* are respectively top and partial side elevation views of another embodiment of a structural insulated panel in accordance with the present invention, where the side elevation view is shown in phantom.
Figure 5A:
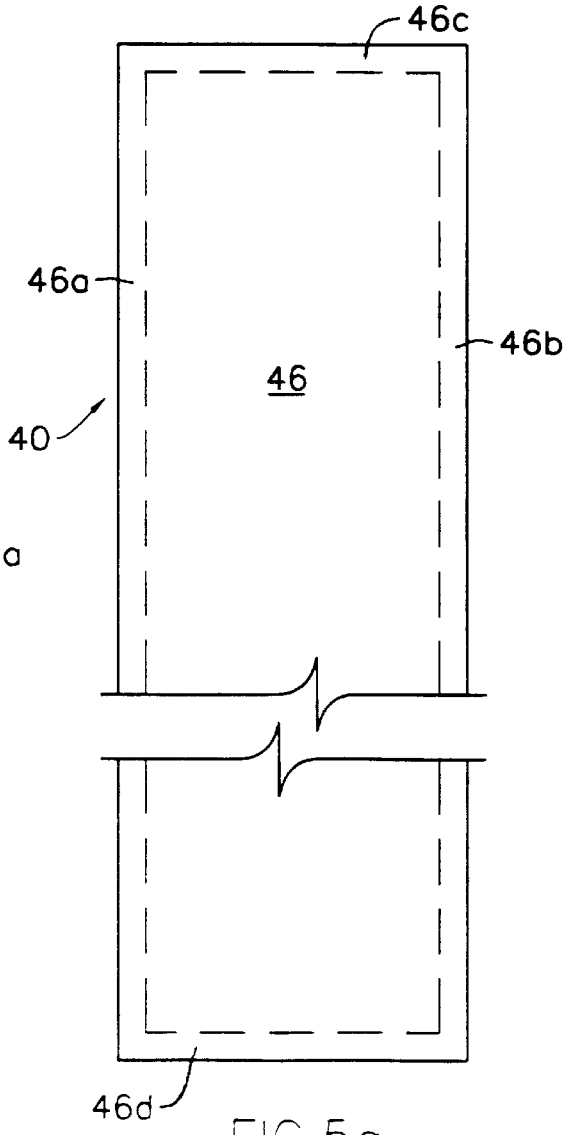

Referring to FIGS. 5 and 5*a*, there are respectively shown top and partial side elevation views of another embodiment of a structural insulated panel 40 in accordance with the present invention. In the embodiment shown in FIGS. 5 and 5*a*, the four edges of first and second outer facings 44 and 46 extend beyond adjacent edges of the panel's insulating core 42. Thus, as shown for the case of the second outer facing 46, the four edges of this facing 46*a*, 46*b*, 46*c* and 46*d* extend beyond the peripheral edges of the panel's insulating core 42. Similarly, periphery edges of the first outer facing 44 extend beyond the edges of the insulating core 42 as shown in FIG. 5 for edges 44*a* and 44*b*. The panel configuration shown in FIGS. 5 and 5*a* provides a continuous slot about the entire periphery of the panel, where linear portions of the peripheral slot are adapted to receive either the edge of another structural insulated panel or a building structural member, neither of which is shown in the figure for simplicity.

Figure 6:
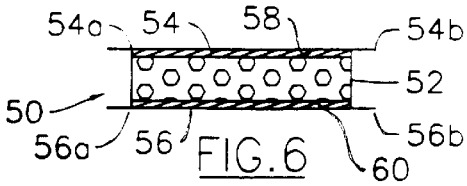
FIG. 6 is a top plan view of another embodiment of a structural insulated panel in accordance with the present invention.
Figure 7:
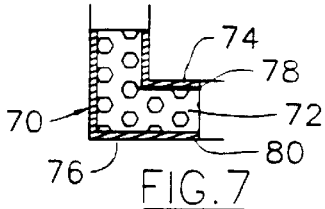
FIG. 7 is a top plan view of a structural insulated panel in accordance with the present invention forming a 90° corner angle.

Referring to FIGS. 6 and 7, there are shown other embodiments of a structural insulated panel in accordance with the present invention. Structural insulated panel 50 shown in FIG. 6 includes an inner insulating core 52 having first and second opposed outer surfaces and first and second backing material sheets 58 and 60 respectively disposed on the first and second outer surfaces of the insulating core. Disposed on the outer surfaces first and second backing material sheets 58, 60 are first and second outer facings 54 and 56, respectively. The first and second backing material sheets 58, 60 extend over the entire outer, opposed surfaces of the panel's insulating core 52 and facilitate attachment of the panel to either another structural insulated panel or to a building structural member. In addition to serving as a continuous nailer, the first and second wood backers 58, 60 substantially increase the strength of the structural insulated panel 50. Conventional adhesives as described above may be used to securely attach the backing material sheets to the insulating core 52 as well as to the outer facings of the panel. The backing material sheets 58, 60 are preferably comprised of wood, heavy paper composite, plastic, metal, or gypsum composite and allow the panel to be sized in the field to fit a particular installation requirement. In the arrangement shown in FIG. 7, the structural insulated panel 70 forms a 90° corner and includes an inner insulating core 72, first and second backing material sheets 78 and 80, and first and second outer facings 74 and 76 respectively attached to the first and second backing material sheets. Opposed ends of the first and second outer facings 74 and 76 extend beyond the edges of the backing material sheets 78, 80 and insulating core 72 to form an overlapping edge portion to facilitate connection of the corner structural insulated panel 70 to adjacent panels or building structural members which are not shown in the figure for simplicity.

Figure 8:
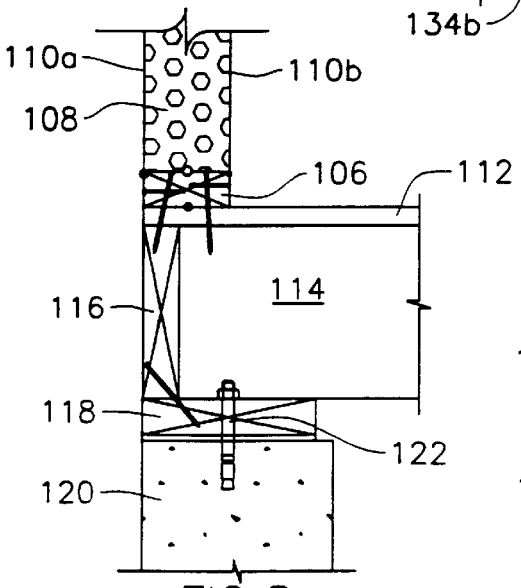
FIG. 8 is a sectional view showing the manner in which a structural insulated panel in accordance with the present invention is installed in a structure of 2× dimension structural lumber members.

Referring to FIG. 8, there is shown a partial sectional view illustrating the manner in which a structural insulated panel 90 in accordance with present invention is installed in a structure of 2× dimensional structural lumber members. Structural insulated panel 90 includes an inner insulating core 108 and first and second outer facings 110*a* and 110*b* disposed on opposed outer surfaces of the insulating core. Upper and lower edges of the first and second outer facings 110*a* and 110*b* extend above and below, respectively, the upper and lower edges of the insulating core 108. Respective upper edges of the first and second outer facings 110*a* and 110*b* are securely attached to a top plate 100 by means of first and second connectors 102*a* and 102*b*, respectively. Top plate 100 is connected to the combination of a roof rafter 92 and ceiling rafter or beam 94 by means of a first connecting bracket 98. A second connecting bracket 96 connects the roof rafter 92 and ceiling rafter 94 together in a secure manner. First and second adhesive beads 104*a* and 104*b* are disposed between respective upper and lower surfaces of the top plate 100 and the ceiling rafter 94 and the panel's insulating core 108 for securely connecting these structural components. Additional adhesive deposits are disposed between the lateral edges of the top plate 100 and respective overlapping edges of the first and second outer facings 110*a* and 110*b* for further connecting structural insulated panel 90 to the top plate. These adhesive deposits increase the strength of the connection between the structural insulated panel 90, top plate 100 and the combination of roof rafter 92 and ceiling rafter 94.

The lower edge of the structural insulated panel's insulating core 108 is positioned on a bottom, or base, plate 106. Base plate 106 is securely attached to the combination of a floor 112 and floor joists 114 and 116 by means of connectors such as nails or screws. As in the case of the upper edge of the structural insulated panel, adjacent overlapping lower edges of the panel's first and second outer facings 110*a* and 110*b* are securely attached to the base plate 106 by means of connectors such as nails or screws. Floor 112 and floor joist 114 and 116 are positioned on and supported by the combination of a base plate 118 and foundation 120. A connecting bolt 122 inserted through base plate 118 securely connects the floor assembly to the foundation 120, which typically is of concrete.

Figure 9:
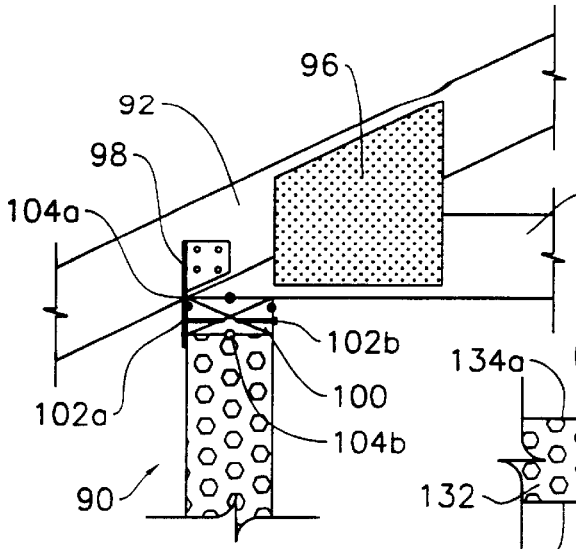
FIG. 9 is a vertical sectional view showing a pair of structural insulated panels in accordance with the present invention each attached to double stud plates for forming an opening such as a doorway.
Figure 9:
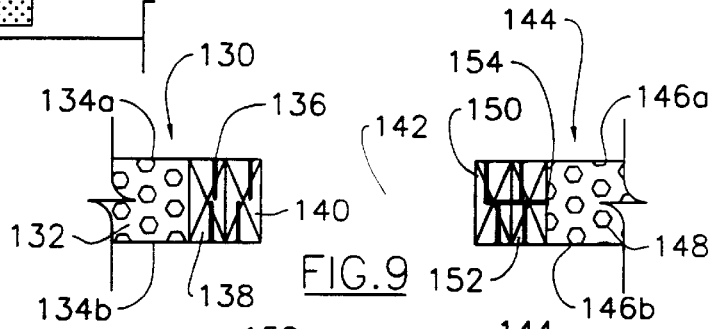
Figure 10:
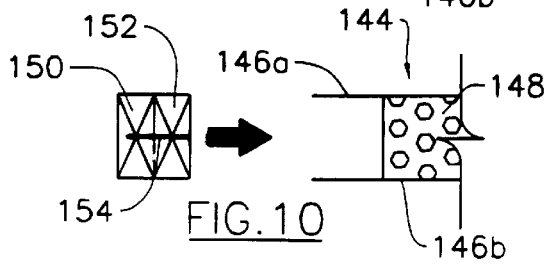
FIG. 10 is an exploded sectional view showing the manner in which a structural insulated panel as shown in FIG. 9 is connected to a double stud plate.

Referring to FIGS. 9 and 10, there are respectively shown simplified sectional views of the manner in which a pair of structural insulated panels 130 and 144 are connected to a double stud arrangement. A first structural insulated panel 130 includes an inner insulating core 132 and first and second outer facings 134*a* and 134*b*. Adjacent edges of the first and second outer facings 134*a*, 134*b* extend beyond the edge of the inner insulating core 132 and form a slot. The slot is adapted to receive first and second studs 138 and 140 forming a double stud insert. Overlapping edges of the first and second outer facings 134*a* and 134*b* are securely attached to the first and second studs 138, 140 by means of plural connectors 136 such as nails or screws. Similarly, a second structural insulated panel 144 includes an inner insulating core 148 and first and second outer facings 146*a* and 146*b*. The slot formed by the overlapping, adjacent edges of the first and second outer facings 146*a*, 146*b* is adapted to receive the combination of a first stud 150 and second stud 152 which are coupled together by means of a connector 154. Additional connectors are inserted through the overlapping edge portions of the first and second outer facings 146*a*, 146*b* and into the first and second studs 150 and 152 forming the double stud insert as shown in FIG. 9. A combination of the double stud inserts and first and second structural insulated panels 130, 134 forms a door opening 142 therebetween.

Figure 11:
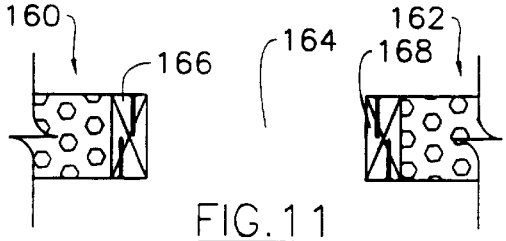
FIG. 11 is a simplified sectional view showing a pair of structural insulated panels in accordance with the present invention attached to a pair of single stud plates in forming an opening such as a doorway.

Referring to FIG. 11, there is shown a similar arrangement wherein first and second structural insulated panels 160 and 162 are connected to first and second studs 166 and 168, respectively, by means of the overlapping edges of the outer facings of the panels to form a door opening 164.

Figure 12:
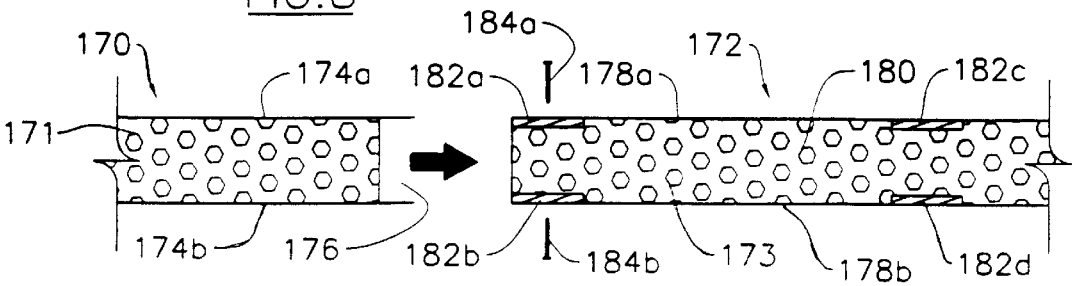
FIG. 12 is an exploded sectional view showing the manner in which a pair of structural insulated panels in accordance with the present invention are securely connected together along their abutting edges.

Referring to FIG. 12, there is shown an exploded sectional view showing the manner in which a pair of structural insulated panels 170 and 172 are securely connected together along their abutting edges in accordance with another aspect of the present invention. The first structural insulated panel 170 includes an inner insulating core 170 and first and second opposed outer facings 174*a* and 174*b*. Overlapping edges of the first and second facings 174*a*, 174*b* form a slot 176 along the edge of the panel's insulating core 171. The second structural insulated panel 172 also includes an inner insulating core 173 and first and second outer facings 178*a* and 178*b*. Disposed within the panel's insulating core 173 and respectively engaging the panel's first and second outer facings 178*a* and 178*b* are a first pair of studs 182*a* and 182*c* and a second pair of studs 182*b* and 182*d*. The edge of the second structural insulated panel 172 adjacent studs 182*a* and 182*b* is adapted for insertion in the edge slot 176 of the first structural insulated panel 170. With the overlapping edges of the first and second outer facings 174*a* and 174*b* of the first structural insulated panel 170 disposed over the first and second outer facings 178*a* and 178*b* of the second structural insulated panel 172, connectors 184*a* and 184*b* are inserted through the overlapping outer facings of the two panels and into studs 182*a* and 182*b*, respectively. In this manner, a pair of overlapping outer facings of the connected panels as well as the inner studs of the panels contribute to the high strength joint formed between adjacent panels in accordance with this aspect of the present invention.

Figure 13:
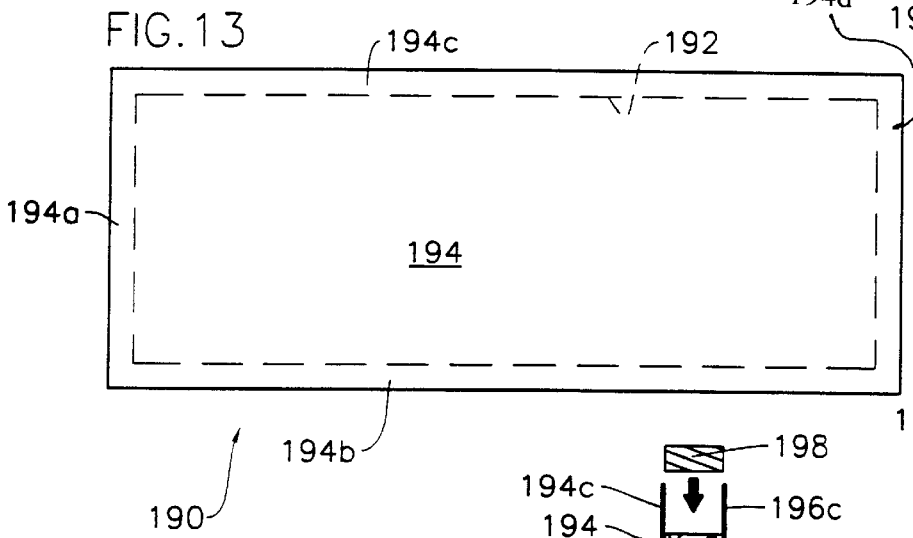
FIGS. 13 and 14 are side elevation and end-on views of another embodiment of a structural insulated panel in accordance with the present invention.
Figure 14:
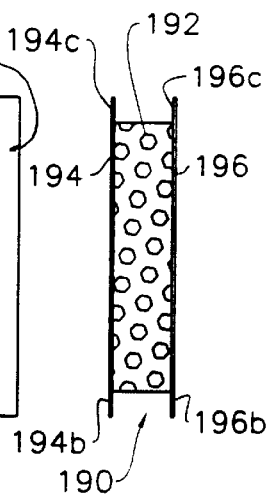
Figure 15:
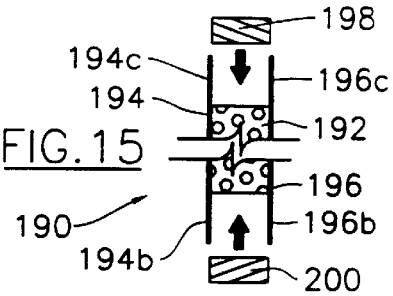
FIG. 15 is a simplified end-on view showing the manner in which the structural insulated panel shown in FIGS. 13 and 14 is connected to a pair of studs along opposed edges of the panel.

Referring to FIGS. 13 and 14, there are respectively shown side elevation and end-on views of another embodiment of a structural insulated panel 190 in accordance with the present invention. In the embodiment shown in FIGS. 13 and 14, all four edges of the panel's first and second outer facings 194 and 196 extend beyond, or overlap, adjacent edges of the panel's insulating core 192. Thus, as shown in the case of the panel's second outer facing 194, the facings peripheral edges 194*a*, 194*b*, 194*c* and 194*d* each extend beyond a respective edge of the panel's insulating core 192. This is also shown in FIG. 14 for two edges 196*c* and 196*b* of the panel's second outer facing 196. This arrangement permits all four edges of the structural insulated panel 190 to be connected in an outer facing overlapping manner to either an adjacent panel(s) or to adjacent building structural members. FIG. 15 shows the manner in which opposed edges of the structural insulated panel 190 are connected to first and second studs 198 and 200. The first stud 198 is inserted in the slot formed by the upper overlapping edges 194*c* and 196*c* of the panel's first and second outer facings 194 and 196. Similarly, the second stud 200 is inserted in the slot formed by the respective lower edges 194*b* and 196*c* of the panel's first and second outer facings 194 and 196. Connectors are inserted through the overlapping edges of the first and second outer facings 194, 196 of the panel and into a respective first or second stud 198, 200, although these connectors are not shown in the figure for simplicity.

Figure 16:
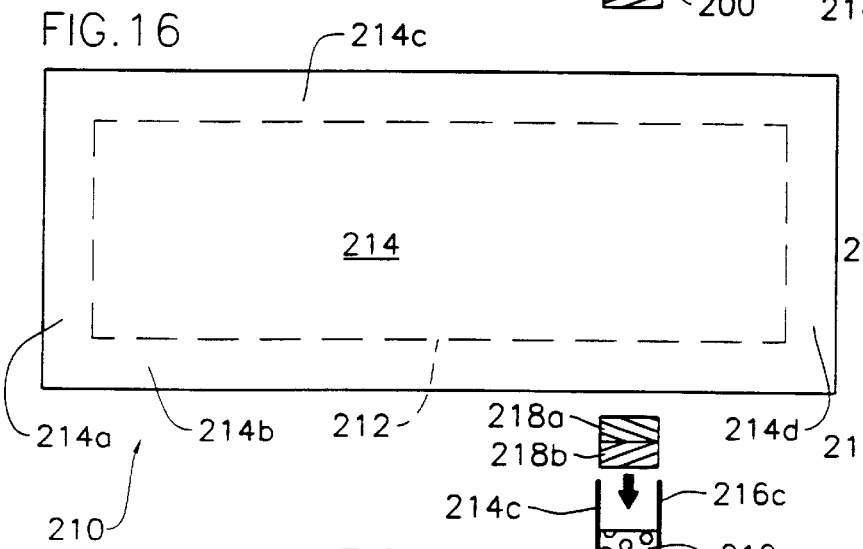
FIGS. 16 and 17 are respectively side elevation and end-on views of another embodiment of a structural insulated panel in accordance with the present invention.
Figure 17:
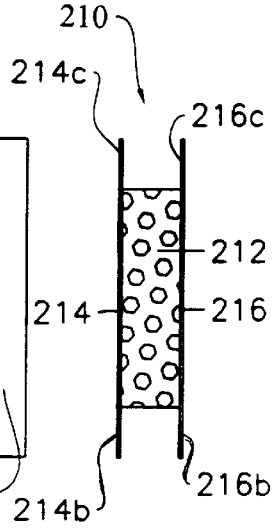
Figure 18:
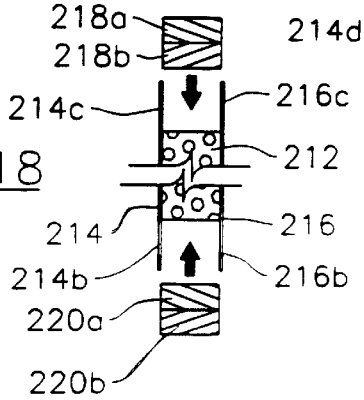
FIG. 18 is an end-view of the structural insulated panel shown in FIGS. 16 and 17 illustrating the manner in which the panel is connected to a pair of double stud plates.

Referring to FIGS. 16 and 17, there are respectively shown side elevation and end-on views of another embodiment of a structural insulated panel connection system in accordance with the present invention. Structural insulated panel 210 includes first and second outer facings 214 and 216 attached to respective opposed outer surfaces of the panel's inner insulating core 212. All four edges of each of the panel's first and second outer facings 214, 216 overlap adjacent edges of the panel's inner insulating core 212. Thus, respective edges 214*a*, 214*b*, 214*c* and 214*d* of the panel's first outer facing 214 overlap, or extend beyond, respective edges of the panel's insulating core 212. Similarly, the four edges of the panel's second outer facing 216 extend beyond respective edges of the panel's insulating core 212 as shown for the case of edges 216*c* and 216*b* in FIG. 17. As shown in FIG. 18, each of the slots in opposed edges of the panel is adapted to receive a pair of studs forming a plate or header connection. As shown in the figure, first and second studs 218*a* and 218*b* are inserted in the slot formed by facing edges 214*c* and 216*c* of the first and second outer facings 214, 216. Similarly, third and fourth studs 220*a* and 220*b* are inserted in the slot formed by facing edges 214*b* and 216*b* of the first and second outer facings 214, 216. Connectors inserted through the facing edges and into the connected studs securely attach the panel to the double stud combination.

Figure 19:
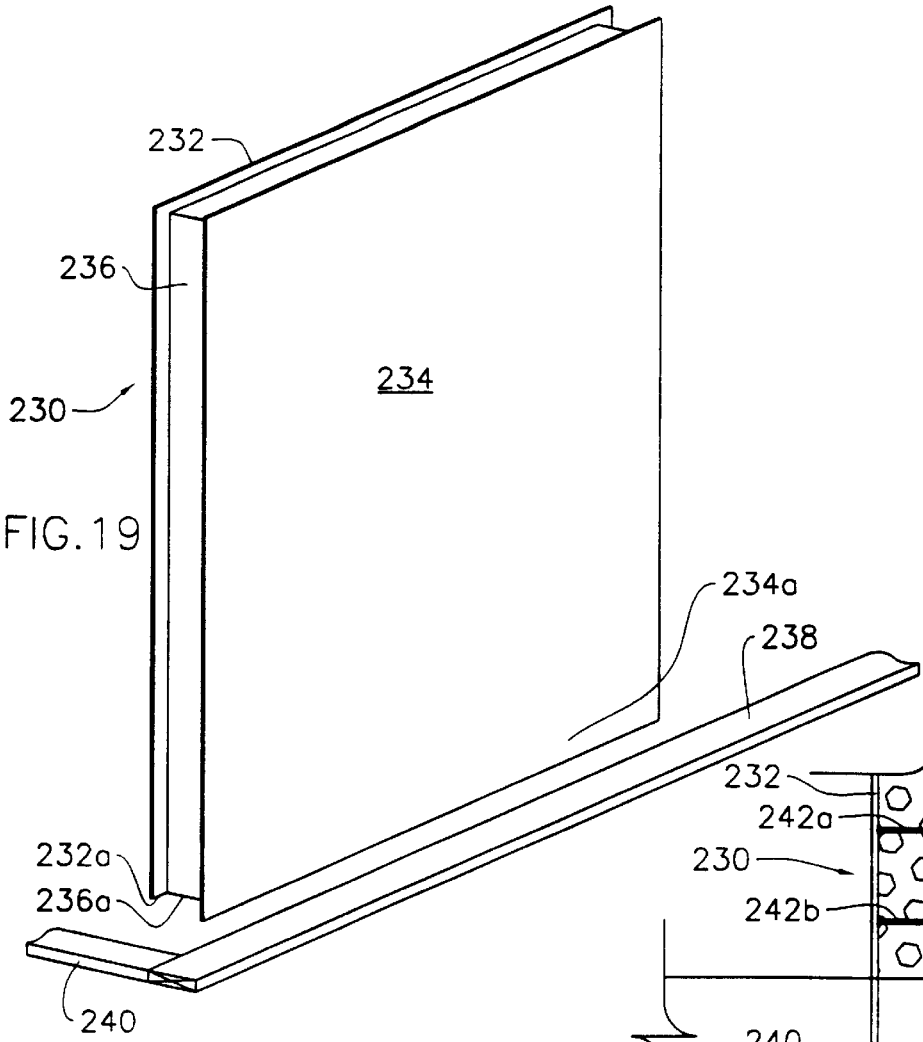
FIGS. 19, 20 and 21 show the manner in which a structural insulated panel in accordance with the present invention is securely connected to a pair of base plate members formed of 2× dimensional structural lumber members forming a 90° angle.
Figure 20:
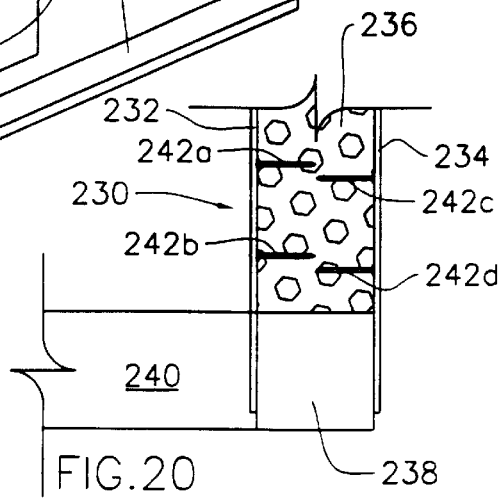
Figure 21:
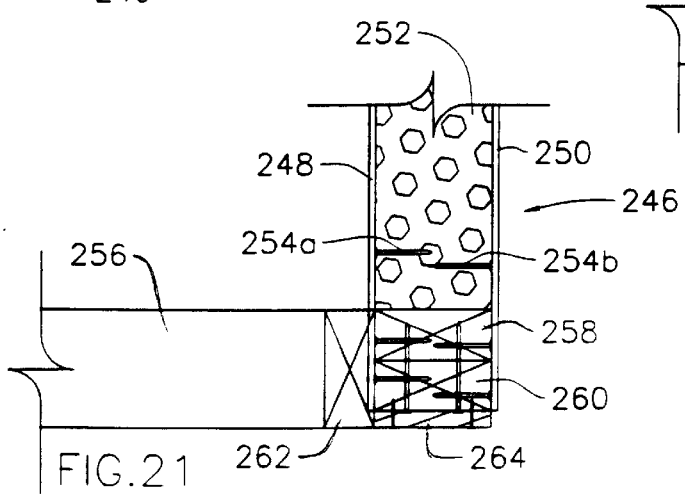

Referring to FIGS. 19, 20 and 21, there is shown the manner in which a structural insulated panel 230 in accordance with the present invention is securely connected to a pair of base plate members formed of 2× dimensional structural number members forming a 90° angle. The structural insulated panel 230 includes an inner insulating core 236 and first and second outer facings 232 and 234 attached to opposed outer surfaces of the insulating core. The structural insulated panel 230 is generally rectangular in shape and is adapted for secure attachment to first and second base plates 238 and 240 forming a generally 90° angle. The lower edge 234*a* of the panel's second outer facing 234 overlaps the first base plate 238 and is secured to the first base plate by means of connectors 242*c* and 242*d*. Similarly, the lower edge of the panel's first outer facing 232 overlaps the opposed surface of the first base plate 238 and is attached to the base plate by means of connectors 242*a* and 242*b*. An end portion of the lower edge of the panel's first outer facing 232 includes a notched, or cutout, corner 232*a* which is adapted for positioning adjacent edges of the second base plate 240. The notched corner 232*a* of the panel's first outer facing 232 allows the panel to be positioned upon and attached to the first and second base plates 238, 240 arranged at a 90° angle.

FIG. 21 shows another arrangement for attaching a structural insulated panel 246 to a pair of base plate members arranged at 90° so as to form a corner. Structural insulated panel 246 includes an inner insulating core 254 and first and second outer facings 248 and 250 attached to opposed outer surfaces of the core. The panel is connected to one of the base plates by means of a pair of connectors 254*a* and 254*b*. A second base plate 256 extends at 90° relative to the first base plate. Extending upwardly from the intersection of the first and second base plates are first and second corner studs 258 and 260 which are attached to the panel's first and second outer facings 248, 250 by means of plural connectors. A third generally vertical corner stud 262 extends upwardly from base plate 256 and is attached to the first and second corner studs 258, 260 by means of a connector. A corner nailer 264 is connected to the corner stud arrangement by means of plural connectors.

Figure 22:
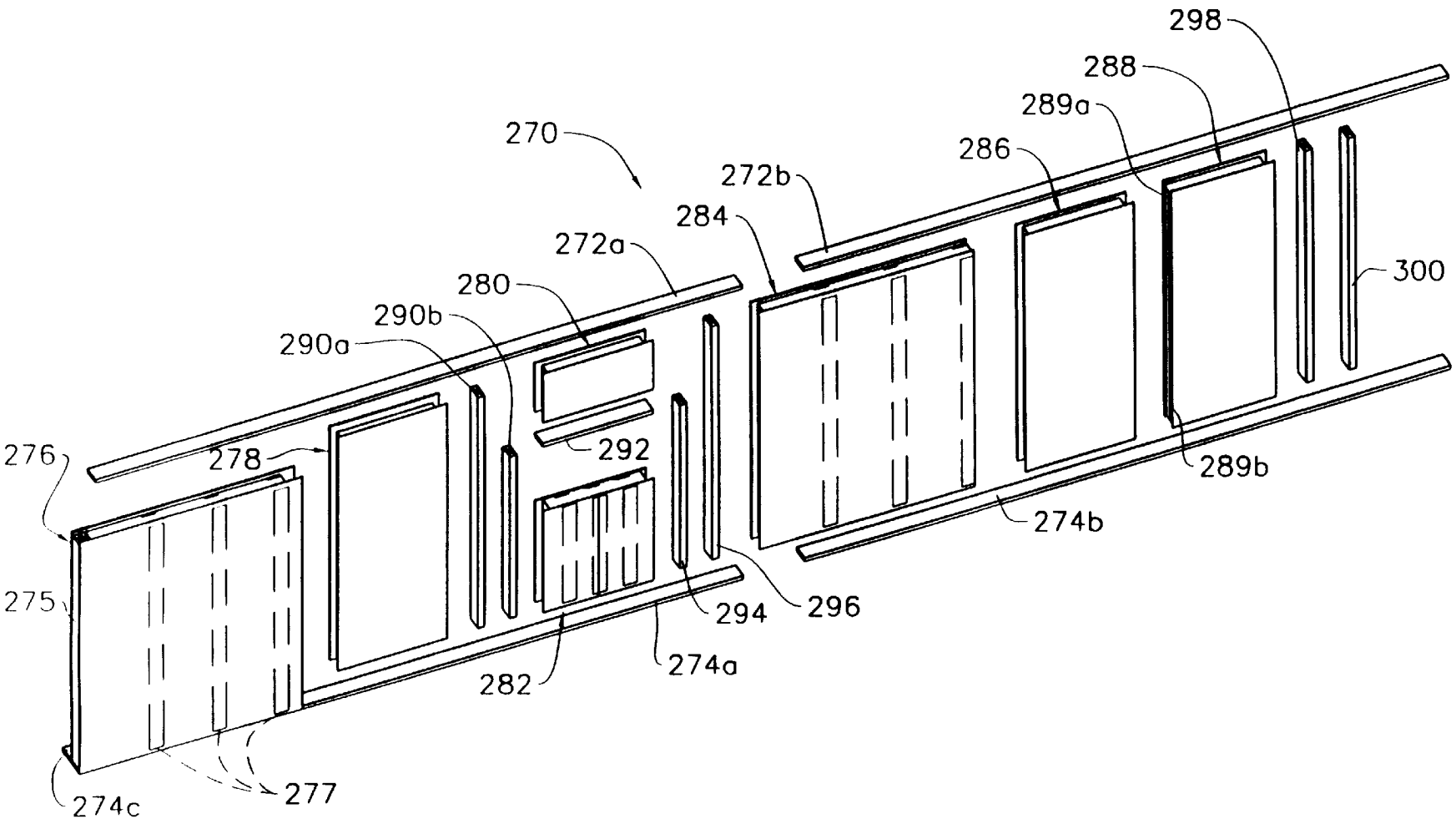
FIG. 22 is an exploded perspective view of a structural insulated panel building system system for forming a wall or ceiling in accordance with the principles of the present invention.

Referring to FIG. 22, there is shown an exploded perspective view of a structural insulated panel building system 270 such as for forming a wall or ceiling in accordance with the present invention the building structure includes first and second top plate members 272*a* and 272*b*, as well as first, second and third base plate members 274*a*, 274*b* and 274*c*. Each of the top and base plate members is typically in the form of a 2×dimensional lumber member. The third base plate member 274*c* forms a 90° angle with the remaining base plate members as well as with the top plate members. A first structural panel 276 is attached to the first top plate member 272*a* and the first base plate member 274*a* as previously described. The first structural insulated panel 276 is located at the corner of the wall or ceiling and is further attached to a pair of studs 275. The first structural insulated panel 276 includes plural inner studs 277 (shown in dotted line form) for increasing the strength of the panel as well as facilitating its attachment to building structural members. The peripheral edges of the panel's first and second facings overlap adjacent building structural members to facilitate attachment of the panel by conventional connectors as previously described. The first structural insulated panel 276 is adapted for secure connection to a second, adjacent structural insulated panel 278 by inserting an edge of the first panel into the notched lateral edge portion of the second panel formed by the opposed, spaced edge portions of the second panel's outer facings. Conventional connectors inserted through the edge portions of the outer facings of the second structural insulated panel 278 through adjacent portions of the outer facings of the first structural insulated panel 276 and into the inner studs of the first panel securely connect the first and second structural insulated panels. An opposed lateral vertical edge of the second structural insulated panel 278 is adapted to receive a first stud 290*a* in a tight fitting manner. A second adjacent stud 290*b* is connected to the first stud 290*a* and is connected to third and fourth structural insulated panels 280 and 282 as well as to a third horizontal stud 292. Overlapping edges of the third and fourth structural insulated panels 280, 282 are used for coupling these panels to second stud 290*b*, third stud 292 and a fourth stud 294 by means of conventional connectors. The third and fourth structural insulated panels 280, 282 are sized to fit the specific dimensions required in the structural insulated panel building system 270 as previously described. A fifth stud 296 is connected to the fourth stud 294 as well as to the first top plate 272*a* and the first base plate member 274*a* by conventional connectors. A fifth structural insulated panel 284 is adapted for secure coupling to the fifth stud 296 as well as to the second top plate member 272*b* and the second base plate member 274*b* by connectors inserted through peripheral edges of the outer facings of the panel and into the aforementioned structural support members. A lateral edge of the structural insulated panel 284 is adapted for insertion into a notch formed on an edge of a fourth structural insulated panel 286 and for connection thereto by conventional connectors. Similarly, an opposed lateral edge of the sixth structural insulated panel 286 is adapted for receiving an adjacent abutting edge of a seventh structural insulated panel 288. The seventh structural insulated panel 288 includes first and second backing material sheets 289*a* and 289*b* attached to opposed outer surfaces of the panel's inner insulating core as well as to the two outer facings of the panel. The first and second backing material sheets 289*a*, 289*b* facilitate attachment of the seventh structural insulated panel 288 to the sixth structural insulated panel 286. An opposed, lateral edge of the seventh structural insulated panel is adapted to receive sixth and seventh studs 298 and 300 and for secure attachment to these studs by means of conventional connectors inserted through adjacent edges of the panel's two outer facings.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A structural arrangement for a building having plural connected support members, said structural arrangement comprising:

a first planar insulating core having plural peripheral edges and first and second opposed outer surfaces;

first and second reinforced paper sheets respectively disposed on the core's first and second opposed surfaces and having respective plural peripheral edges each extending beyond an adjacent edge of said core and forming a slot disposed about at least a portion of the periphery of said core;

a building support member disposed in a first portion of said slot and engaging a peripheral edge of said core; and a first connector inserted through an edge of said first reinforced paper sheet extending beyond an adjacent edge of said core, wherein said first connector is further inserted into said building support member for securely attaching said core to said building support member.

2. The structural arrangement of claim 1 wherein said building support member is a 2× dimensional structural member.

3. The structural arrangement of claim 1 wherein said first insulating core and said first and second reinforced paper sheets are generally rectangular, with said building support member engaging a first peripheral edge of said first core and said first connector inserted through a first edge of said first reinforced paper sheet adjacent the first peripheral edge of said first core.

4. A structural arrangement for a building having plural connected support members, said structural arrangement comprising:

a first planar insulating core having plural peripheral edges and first and second opposed outer surfaces;

first and second reinforced paper sheets respectively disposed on the core's first and second opposed surfaces and having respective plural peripheral edges each extending beyond an adjacent edge of said core and forming a slot disposed about at least a portion of the periphery of said core;

a building support member disposed in a first portion of said slot and engaging a peripheral edge of said core;

a first connector inserted through an edge of said first reinforced paper sheet extending beyond an adjacent edge of said core, wherein said first connector is further inserted into said building support member for securely attaching said core to said building support member; and a second planar insulating core having third and fourth reinforced paper sheets respectively disposed on opposed surfaces thereof, wherein adjacent edges of said second core and said third and fourth reinforced paper sheets are inserted into a second portion of said slot with said third and fourth reinforced paper sheets disposed in contact said first and second reinforced paper sheets, respectively, and a second connector inserted through adjacent overlapping portions of said first and third reinforced paper sheets and into said second core for securely connecting said first and second cores.

5. The structural arrangement of claim 4 further comprising a third connector inserted through an edge of said second reinforced paper sheet extending beyond an adjacent edge of said first core, wherein said third connector is further inserted into said building support member for securely attaching said first core to said building support member.

6. The structural arrangement of claim 5 further comprising a fourth connector inserted through adjacent overlapping portions of said second and fourth reinforced paper sheets and into said second core.

7. The structural arrangement of claim 6 further comprising a first strut disposed in said second core in a contact with said third reinforced paper sheet, wherein said second connector is inserted into said first strut.

8. The structural arrangement of claim 7 further comprising a second strut disposed in said second core and in contact with said fourth reinforced paper sheet, wherein said fourth connector is inserted into said second strut.

9. The structural arrangement of claim 8 wherein said first and second struts are comprised of wood, heavy paper composite, plastic or metal.

10. The structural arrangement of claim 9 wherein said connectors are nails, staples or screws.

11. The structural arrangement of claim 1 further comprising a strut disposed in said first planar insulating core and in contact with said first reinforced paper sheet for increasing the strength of said first core and facilitating attachment of said first core to another core or to a building support member.

12. The structural arrangement of claim 1 further comprising a backing material sheet disposed between and attached to said first reinforced paper sheet and the first surface of said first insulating core for increasing the strength of said structural arrangement and facilitating attachment of said first insulating core to a support member.

13. The structural arrangement of claim 12 wherein said backing material sheet is comprised of wood, heavy paper composite, plastic, metal, or gypsum composite.

14. A structural arrangement comprising:

a first planar insulating core having plural peripheral edges and first and second opposed outer surfaces;

first and second reinforced paper sheets respectively disposed on the core's first and second opposed surfaces and having respective plural peripheral edges each extending beyond an adjacent edge of said core and forming a slot disposed about at least a portion of the periphery of said core; and a second planar insulating core having third and fourth reinforced paper sheets respectfully disposed on opposed surfaces thereof, wherein adjacent edges of said second core and said third and fourth reinforced paper sheets are inserted into said slot with said third and fourth reinforced paper sheets disposed in contact said first and second reinforced paper sheets, respectively, and a connector inserted through adjacent overlapping portions of said first and third reinforced paper sheets and into said second core for securely connecting said first and second cores.

* * * * *

UNITED STATES PATENT AND TRADEMARK OFFICE

CERTIFICATE OF CORRECTION

PATENT NO. : 6,698,157 B1
DATED : March 2, 2004
INVENTOR(S) : William H. Porter

It is certified that error appears in the above-identified patent and that said Letters Patent is hereby corrected as shown below:

Title page,
Item [56], References Cited, U.S. PATENT DOCUMENTS, delete U.S. Patent No. "5,932,171 dated 8/1999 to Malchesky" and insert in its place U.S. Patent No. -- 4,932,171 dated 6/1990 to Beattie --

Column 3,
Line 15, delete "end-view" and insert in its place -- end-on view --

Column 9,
Line 4, after the word "invention" end the sentence with a period -- . -- and a space, and then capitalize the word "The"
Line 8, insert a space between "2x" and "dimensional"

Signed and Sealed this

Eleventh Day of May, 2004

JON W. DUDAS
*Acting Director of the United States Patent and Trademark Office*